US006484505B1

(12) United States Patent
Brown et al.

(10) Patent No.: US 6,484,505 B1
(45) Date of Patent: Nov. 26, 2002

(54) COMBUSTOR LINER COOLING THIMBLES AND RELATED METHOD

(75) Inventors: Daniel Mark Brown, Altamont, NY (US); David Orus Fitts, Ballston Spa, NY (US); Stephen Hugh Black, Belfort (FR)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/513,070

(22) Filed: Feb. 25, 2000

(51) Int. Cl.[7] ..... F02C 7/18
(52) U.S. Cl. ..... 60/760
(58) Field of Search ..... 60/752, 760

(56) References Cited

U.S. PATENT DOCUMENTS

| | | | | |
|---|---|---|---|---|
| 4,339,925 A | | 7/1982 | Eggmann et al. | |
| 4,719,748 A | | 1/1988 | Davis, Jr. et al. | |
| 4,872,312 A | * | 10/1989 | Iizuka et al. | 60/760 |
| 5,388,412 A | * | 2/1995 | Werning et al. | 60/760 |
| 5,499,499 A | | 3/1996 | Ambrogi et al. | |
| 5,533,864 A | | 7/1996 | Nomoto et al. | |
| 5,575,154 A | | 11/1996 | Loprinzo | |
| 5,687,572 A | * | 11/1997 | Schrantz et al. | 60/752 |
| 5,737,915 A | | 4/1998 | Lin et al. | |
| 5,749,229 A | * | 5/1998 | Abuaf et al. | 60/752 |
| 5,784,876 A | * | 7/1998 | Alkabie | 60/752 |
| 6,000,908 A | | 12/1999 | Bunker | |

FOREIGN PATENT DOCUMENTS

| | | |
|---|---|---|
| GB | 1 356 114 | 6/1974 |
| JP | 09 041991 A | 2/1997 |

OTHER PUBLICATIONS

"39$^{th}$ GE Turbine State–of–the–Art Technology Seminar", Tab 1, ""F" Technology—the First Half–Million Operating Hours", H.E. Miller, Aug. 1996.

(List continued on next page.)

*Primary Examiner*—Michael Koczo
(74) *Attorney, Agent, or Firm*—Nixon & Vanderhye P.C.

(57) ABSTRACT

A combustor for a turbine includes a combustor liner; a first flow sleeve surrounding the liner, the flow sleeve having a plurality of rows of cooling holes formed about a circumference of the flow sleeve; and a transition piece connected to the combustor liner and the flow sleeve and adapted to carry hot combustion gases to a stage of the turbines. The transition piece is surrounded by a second flow sleeve which directs cooling air to the transition piece. One of the plurality of rows of cooling holes in the first flow sleeve is located adjacent the transition piece, and cooling conduits are mounted in the cooling holes of at least the first of the plurality of rows of cooling holes to direct impingement cooling air against the surface of the liner while diverting crossflow cooling air around the impingement cooling air. A related method of cooling a combustor liner of a gas turbine combustor with a flow sleeve surrounding the liner in substantially concentric relationship therewith includes the steps of a) providing a plurality of axially spaced rows of cooling holes in the flow sleeve, each row extending circumferentially of the flow sleeve, a first of the rows adjacent a forward or downstream end of the flow sleeve; b) locating a plurality of cooling conduits in the cooling holes of at least the first of the rows, the cooling conduits extending radially towards, but not engaging, the liner; and c) supplying cooling air to the annulus such that the cooling conduits direct the cooling air against the liner.

8 Claims, 5 Drawing Sheets

OTHER PUBLICATIONS

"39th GE Turbine State–of–the–Art Technology Seminar", Tab 2, "GE Heavy–Duty Gas Turbine Performance Characteristics", F. J. Brooks, Aug. 1996.
"39th GE Turbine State–of–the–Art Technology Seminar", Tab 3, "9EC 50Hz 170–MW Class Gas Turbine", A. S. Arrao, Aug. 1996.
"39th GE Turbine State–of–the–Art Technology Seminar", Tab 4, "MWS6001FA—An Advanced–Technology 70–MW Class 50/60 Hz Gas Turbine", Ramachandran et al., Aug. 1996.
"39th GE Turbine State–of–the–Art Technology Seminar", Tab 5, "Turbomachinery Technology Advances at Nuovo Pignone", Benvenuti et al., Aug. 1996.
"39th GE Turbine State–of–the–Art Technology Seminar", Tab 6, "GE Aeroderivative Gas Turbines—Design and Operating Features", M.W. Horner, Aug. 1996.
"39th GE Turbine State–of–the–Art Technology Seminar", Tab 7, "Advance Gas Turbine Materials and Coatings", P.W. Schilke, Aug. 1996.
"39th GE Turbine State–of–the–Art Technology Seminar", Tab 8, "Dry Low $NO_x$ Combustion Systems for GE Heavy–Duty Turbines", L. B. Davis, Aug. 1996.
"39th GE Turbine State–of–the–Art Technology Seminar", Tab 9, "GE Gas Turbine Combustion Flexibility", M.A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines,"J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R.C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J.F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1,1994–Aug. 31, 1995.
"Advanced Turbine Systems (ATS Program) Conceptual Design and Product Development", Final Technical Progress Report, vol. 2– Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.

"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develope State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MC7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century—"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, p. 3–13, Oct., 1995.
"Proceedings of the Advanced Turbine Systems Annual Program Review Meeting", vol. I, "H Gas Turbine Combined Cycle", J. Corman, p. 14–21, Oct., 1995.
"Proceedings of the Advanced Turbine Systems Annual Program Review Meeting", vol. I, "Overview of Westinghouse's Advanced Turbine Systems Program", Bannister et al., p. 22–30, Oct., 1995.
"Proceedings of the Advanced Turbine Systems Annual Program Review Meeting", vol. I, "Allison Engine ATS Program Technical Review", D. Mukavetz, p. 31–42, Oct., 1995.
"Proceedings of the Advanced Turbine Systems Annual Program Review Meeting", vol. I, "Advanced Turbine Systems Program Industrial System Concept Development", S. Gates, p. 43–63, Oct., 1995.
"Proceedings of the Advanced Turbine Systems Annual Program Review Meeting", vol. I, "Advanced Turbine System Program Phase 2 Cycle Selection", Latcovich, Jr., p. 64–69, Oct., 1995.
"Proceedings of the Advanced Turbine Systems Annual Program Review Meeting", vol. I, "General Electric ATS Program Technical Review Phase 2 Activities", Chance et al., p. 70–74, Oct., 1995.
"Proceedings of the Advanced Turbine Systems Annual Program Review Meeting", vol. I, "Technical Review of Westinghouse's Advanced Turbine Systems Program", Diakunchak et al., p. 75–86, Oct., 1995.
"Proceedings of the Advanced Turbine Systems Annual Program Review Meeting", vol. I, "Advanced Combustion Turbines and Cycles: An EPRI Perspective", Touchton et al., p. 87–88, Oct., 1995.
"Proceedings of the Advanced Turbine Systems Annual Program Review Meeting", vol. I, "Advanced Turbine Systems Annual Program Review", William E. Koop, pp. 89–92, Oct., 1995.
"Proceedings of the Advanced Turbine Systems Annual Program Review Meeting", vol. I, "The AGTSR Consortium: An Update", Fant et al., pp. 93–102, Oct., 1995.
"Proceedings of the Advanced Turbine Systems Annual Program Review Meeting", vol. I, "Overview of Allison/AGTSR Interactions", Sy A. Ali, pp. 103–106, Oct., 1995.
"Proceedings of the Advanced Turbine Systems Annual Program Review Meeting", vol. I, "Design Factors for Stable Lean Premix Combustion", Richards et al., pp. 107–113, Oct., 1995.
"Proceedings of the Advanced Turbine Systems Annual Program Review Meeting", vol. I, "Ceramic Stationary as Turbine", M. van Roode, pp. 114–147, Oct., 1995.
"Proceedings of the Advanced Turbine Systems Annual Program Review Meeting", vol. I, "DOE/Allison Ceramic Vane Effort", Wenglarz et al., pp. 148–151, Oct., 1995.

"Proceedings of the Advanced Turbine Systems Annual Program Review Meeting", vol. I, "Materials/Manufacturing Element of the Advanced Turbine Systems Program", Karnitz et al., pp. 152–160, Oct., 1995.
"Proceedings of the Advanced Turbine Systems Annual Program Review Meeting", vol. I, "Land–Based Turbine Casting Initiative", Mueller et al., pp. 161–170, Oct., 1995.
"Proceedings of the Advanced Turbine Systems Annual Program Review Meeting", vol. I, "Turbine Airfoil Manufacturing Technology", Kortovich, pp. 171–181, Oct., 1995.
"Proceedings of the Advanced Turbine Systems Annual Program Review Meeting", vol. I, "Pratt & Whitney Thermal Barrier Coatings", Bornstein et al., pp. 182–193, Oct., 1995.
"Proceedings of the Advanced Turbine Systems Annual Program Review Meeting", vol. I, "Westinhouse Thermal Barrier Coatings", Goedjen et al., pp. 194–199, Oct., 1995.
"Proceedings of the Advanced Turbine Systems Annual Program Review Meeting", vol. I, "High Performance Steam Development", Duffy et al., pp. 200–220, Oct., 1995.
"Proceedings of the Advanced Turbine Systems Annual Program Review Meeting", vol. II, "Lean Premixed Combustion Stabilized by Radiation Feedback and heterogeneous Catalysis", Dibble et al., pp. 221–232, Oct., 1995.
"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct., 1995.
"Proceedings of the Advanced Turbine Systems Annual Program Review Meeting", vol. II, "Lean Premixed Flames for Low $No_X$ Combustors", Sojka et al., pp. 249–275, Oct., 1995.
"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct., 1995.
"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.
"Proceedings of the Advanced Turbine Systems Annual Program Review Meeting", vol. II, "Life Prediction of Advanced Materials for Gas Turbine Application", Zamrik et al., pp. 310–327, Oct., 1995.
"Proceedings of the Advanced Turbine Systems Annual Program Review Meeting", vol. II, "Advanced Combustion Technologies for Gas Turbine Power Plants", Vandsburger et al., pp. 328–352, Oct., 1995.
"Proceedings of the Advanced Turbine Systems Annual Program Review Meeting", vol. II, "Combustion Modeling in Advanced Gas Turbine Systems", Smoot et al., pp. 353–370, Oct., 1995.
"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.
"Proceedings of the Advanced Turbine Systems Annual Program Review Meeting", vol. II, "Rotational Effects on Turbine Blade Cooling", Govatzidakia et al., pp. 391–392, Oct., 1995.
"Proceedings of the Advanced Turbine Systems Annual Program Review Meeting", vol. II, "Manifold Methods for Methane Combustion", Yang et al., pp. 393–409, Oct., 1995.
"Proceedings of the Aadvanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.
"Proceedings of the Advanced Turbine Systems Annual Program Review Meeting, vol. II", The Role of Reactant Unmixedness, Strain Rate, and Length Scale on Premixed Combustor Performance, Samuelsen et al., pp. 415–422, Oct., 1995.
"Proceedings of the Advanced Turbine Systems Annual Program Review Meeting", vol. II, "Experimental and Computational Studies of Film Cooling With Compound Angle Injection", Goldstein et al., pp. 423–451, Oct., 1995.
"Proceedings of the Advanced Turbine Systems Annual Program Review Meeting", vol. II, "Compatibility of Gas Turbine Materials with Steam Cooling", Desai et al., pp. 452–464, Oct., 1995.
"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, pp. 465–473, Oct., 1995.
"Proceedings of the Advanced Turbine Systems Annual Program Review Meeting", vol. II, Effects of Geometry on Slot–Jet Film Cooling Performance, Hyams et al., pp. 474–496 Oct., 1995.
"Proceedings of the Advanced Turbine Systems Annual Program Review Meeting", vol. II, "Steam as Turbine Blade Coolant: Experimental Data Generation", Wilmsen et al., pp. 497–505, Oct., 1995.
"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct., 1995.
"Proceedings of the Advanced Turbine Systems Annual Program Review Meeting", vol. II, "Premixed Burner Experiments: Geometry, Mixing, and Flame Structure Issues", Gupta et al., pp. 516–528, Oct., 1995.
"Proceedings of the Advanced Turbine Systems Annual Program Review Meeting", vol. II, "Intercooler Flow Path for Gas Turbines: CFD Design and Experiments", Agrawal et al., pp. 529–538, Oct., 1995.
"Proceedings of the Advanced Turbine Systems Annual Program Review Meeting", vol. II, "Bond Strength and Stress Measurements in Thermal Barrier Coatings", Gell et al., pp. 539–549, Oct., 1995.
"Proceedings of the Advanced Turbine Systems Annual Program Review Meeting", vol. II, "Active Control of Combustion Instabilities in Low $NO_X$ Gas Turbines", Zinn et al., pp. 550–551, Oct., 1995.
"Proceedings of the Advanced Turbine Systems Annual Program Review Meeting", vol. II, "Combustion Instability Modeling and Analysis", Santoro et al., pp. 552–559, Oct., 1995.
"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.
"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, pp. 3–16, Nov., 1996.

"Proceedings of the Advanced Turbine Systems Annual Program Review Meeting", "Power Needs in the Chemical Industry", Keith Davidson, pp. 17–26, Nov., 1996.

"Proceedings of the Advanced Turbine Systems Annual Program Review Meeting", "Advanced Turbine Systems Program Overview", David Esbeck, p. 27–34, Nov., 1996.

"Proceedings of the Advanced Turbine Systems Annual Program Review Meeting", "Westinghouse's Advanced Turbine Systems Program", Gerard McQuiggan, p. 35–48, Nov., 1996.

"Proceedings of the Advanced Turbine Systems Annual Progam Review Meeting", "Overview of GE's H Gas Turbine Combined Cycle", Cook et al., p. 49–72, Nov., 1996.

"Proceedings of the Advanced Turbine Systems Annual Program Review Meeting", "Allison Advanced Simple Cycle Gas Turbine System", William D. Weisbrod, p. 73–94, Nov., 1996.

"Proceedings of the Advanced Turbine Systems Annual Program Review Meeting", "The AGTSR Industry–University Consortium", Lawrence P. Golan, p. 95–110, Nov., 1996.

"Proceedings of the Advanced Turbine Systems Annual Program Review Meeting", "$NO_X$ and CO Emissions Models for Gas–Fired Lean–Premixed Combustion Turbines", A. Mellor, p. 111–122, Nov., 1996.

"Proceedings of the Advanced Turbine Systems Annual Program Review Meeting", "Methodologies for Active Mixing and Combustion Control", Uri Vandsburger, p. 123–156, Nov., 1996.

"Proceedings of the Advanced Turbine Systems Annual Program Review Meeting", "Combustion Modeling in Advanced Gas Turbine Systems", Paul O. Hedman, p. 157–180, Nov., 19967.

"Proceedings of the Advanced Turbine Systems Annual Program Review Meeting", "Manifold Methods for Methane Combustion", Stephen B. Pope, p. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, p. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, p. 211–232, Nov., 1996.

"Proceedings of the Advanced Turbine Systems Annual Program Review Meeting", "Combustion Instability Studies Application to Land–Based Gas Turbine Combustors", Robert J. Santoro, p. 233–252.

"Proceedings of the Advanced Turbine Systems Annual Program Review Meeting", Active Control of Combustion Instabilities in Low $NO_X$ Turbines, Ben T. Zinn, p. 253–264, Nov., 1996.

"Proceedings of the Advanced Turbine Systems Annual Program Review Meeting", "Life Prediction of Advanced Materials for Gas Turbine Application," Sam Y. Zamrik, p. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, p. 275–290, Nov., 1996.

"Proceedings of the Advanced Turbine Systems Annual Program Review Meeting", "Compatibility of Gas Turbine Materials with Steam Cooling", Vimal Desai, p. 291–314, Nov., 1996.

"Proceedings of the Advanced Turbine Systems Annual Program Review Meeting", "Bond Strength and Stress Measurements in Thermal Barrier Coatings", Maurice Gell, p. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, p. 335–356, Nov., 1996.

"Proceedings of the Advanced Turbine Systems Annual Program Review Meeting", "Flow Characteristics of an Intercooler System for Power Generating Gas Turbines", Ajay K. Agrawal, p. 357–370, Nov., 1996.

"Proceedings of the Advanced Turbine Systems Annual Program Review Meeting", "Improved Modeling Techniques for Turbomachinery Flow Fields", B. Lakshiminarayana, p. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, p. 393–406, Nov., 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, p. 427–446.

"Proceedings of the Advanced Turbine Systems Annual Program Review Meeting", "Experimental and Computational Studies of Film Cooling with Compound Angle Injection", R. Goldstein, p. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461–470, Nov., 1996.

"Proceedings of the Advanced Turbine Systems Annual Program Review Meeting", "Steam as a Turbine Blade Coolant: External Side Heat Transfer", Abraham Engeda, p. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, p. 483–498, Nov., 1996.

"Proceedings of the Advanced Turbine Systems Annual Program Review Meeting", "Closed–Loop Mist/Steam Cooling for Advanced Turbine Systems", Ting Wang, p. 499–512, Nov., 1996.
"Proceedings of the Advanced Turbine Systems Annual Program Review Meeting", "Heat Pipe Turbine Vane Cooling", Langston et al., p. 513–534, Nov., 1996.
"Proceedings of the Advanced Turbine Systems Annual Program Review Meeting", "EPRI's Combustion Turbine Program: Status and Future Directions", Arthur Cohn, p. 535,–552 Nov., 1996.
"Proceedings of the Advanced Turbine Systems Annual Program Review Meeting", "ATS Materials Support", Michael Karnitz, p. 553–576, Nov., 1996.
"Proceedings of the Advanced Turbine Systems Annual Program Review Meeting", "Land Based Turbine Casting Initiative", Boyd A. Mueller, p. 577–592, Nov., 1996.
"Proceedings of the Advanced Turbine Systems Annual Program Review Meeting", "Turbine Airfoil Manufacturing Technology", Charles S. Kortovich, p. 593–622, Nov., 1996.
"Proceedings of the Advanced Turbine Systems Annual Program Review Meeting", "Hot Corrosion Testing of TBS's", Norman Bornstein, p. 623–631, Nov., 1996.
"Proceedings of the Advanced Turbine Systems Annual Program Review Meeting", "Ceramic Stationary Gas Turbine", Mark van Roode, p. 633–658, Nov., 1996.
"Proceedings of the Advanced Turbine Systems Annual Program Review Meeting", "Western European Status of Ceramics for Gas Turbines", Tibor Bornemisza, p. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1 1997, Report Nos.: DOE/MC/31176—5628.
"Utility Advanced Turbine System (ATS) Technology Readiness Testing—Phase 3", Document #666274, Oct. 1, 1996–Sep. 30, 1997, Publication Date, Dec. 31, 1997, Report Nos.: DOE/MC/31176—10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Nos.: DOE/MC/31176—5340.
"Utility Advanced Turbine System (ATS) Technology Readiness Testing and Pre–Commercial Demonstration—Phase 3", Document #486132, Apr. 1–Jun. 30, 1976, Publication Date, Dec. 31, 1996, Report Nos.: DOE/MC/31176—5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos.: DOE/MC/31176—5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos.: DOE/MC/31176—8.
"Utility Advanced Turbine System (ATS) Technology Readiness Testing and Pre–Commercialization Demonstration" Jan. 1–Mar. 31, 1996, DOE/MC/31176—5338.
"Utility Advanced Turbine System (ATS) Technology Readiness Testing: Phase 3R", Document #756552, Apr. 1–Jun. 30, 1999, Publication Date, Sep. 1, 1999, Report Nos.: DE—FC21–95MC31176–23.
"Utility Advanced Turbine System (ATS) Technology Readiness Testing.", Document #656823, Jan. 1–Mar. 31, 1998, Publication Date, Aug. 1, 1998, Report Nos.: DOE/MC/31176–17.
"Utility Advanced Turbine System (ATS) Technology Readiness Testing and Pre–Commercial Demonstration", Annual Technical Progress Report, Reporting Period: Jul. 1, 1995–Sep. 30, 1996.
"Utility Advanced Turbine Systems (ATS) Technology Readiness Testing", Phase 3R, Annual Technical Progress Report, Reporting Period: Oct. 1, 1997–Sep. 30, 1998.
"Utility Advanced Turbine Systems (ATS) Technology Readiness Testing", Document #750405, Oct. 1–Dec. 30, 1998, Publication Date: May, 1, 1999, Report Nos.: DE–FC21–95MC31176–20.
"Utility Advanced Turbine Systems (ATS) Technology Readiness Testing", Document #1348, Apr. 1–Jun. 29, 1998, Publication Date Oct. 29, 1998, Report Nos. DE–FC21–95MC31176—18.
"Utility Advanced Turbine Systems (ATS) Technology Readiness Testing—Phase 3", Annual Technical Progress Report, Reporting Period: Oct. 1, 1996–Sep. 30, 1997.
"Utility Advanced Turbine Systems (ATS) Technology Readiness Testing and Pre–Commercial Demonstration", Quarterly Report, Jan. 1–Mar. 31, 1997, Document #666275, Report Nos.: DOE/MC/31176–07.
"Proceedings of the 1997 Advanced Turbine Systems", Annual Program Review Meeting, Oct. 28–29, 1997.

* cited by examiner

COMBUSTOR LINER COOLING THIMBLES AND RELATED METHOD

BACKGROUND OF THE INVENTION

This invention relates to combustors in turbo machinery and specifically, to the cooling of combustor liners in gas turbine combustors.

Conventional gas turbine combustion systems employ multiple combustor assemblies to achieve reliable and efficient turbine operation. Each combustor assembly includes a cylindrical liner, a fuel injection system, and a transition piece that guides the flow of the hot gas from the combustor to the inlet of the turbine. Generally, a portion of the compressor discharge air is used to cool the combustion liner and is then introduced into the combustor reaction zone to be mixed with the fuel and burned.

In systems incorporating impingement cooled transition pieces, a hollow sleeve surrounds the transition piece, and the sleeve wall is perforated so that compressor discharge air will flow through the cooling apertures in the sleeve wall and impinge upon (and thus cool) the transition piece. This cooling air then flows along an annulus between the sleeve surrounding the transition piece, and the transition piece itself. This so-called "cross flow" eventually flows into another annulus between the combustion liner and a surrounding flow sleeve. The flow sleeve is also formed with several rows of cooling holes around its circumference, the first row located adjacent a mounting flange where the flow sleeve joins to the outer sleeve of the transition piece. The cross flow is perpendicular to impingement cooling air flowing through the holes in the flow sleeve toward the combustor liner surface.

The presence of this crossflow has a direct influence on the cooling effectiveness in the zone near where the first row of jets in the flow sleeve would have been expected to impingement cool the combustor liner. Specifically, the crossflow impacts the first row of flow sleeve jets, bending them over and degrading their ability to impinge upon the liner. In one prior design of the flow sleeve impingement jets there are three rows of 24 jets spaced evenly around the circumference of the flow sleeve. This jet pattern in the presence of the strong crossflow from the transition piece impingement sleeve produces very low heat transfer rates on the liner surface near the first row of jets. This low heat transfer rate can lead to high liner surface temperatures and ultimately loss of strength. Several potential failure modes due to the high temperature of the liner include, but are not limited to, cracking of the aft sleeve weld line, bulging and triangulation. These mechanisms shorten the life of the liner, requiring replacement of the part prematurely.

SUMMARY OF THE INVENTION

This invention enhances the cooling of the liner in Dry Low NOx type gas turbine combustors where jet impingement is used to cool the aft portion of the combustor liner. Even though there is a strong crossflow resulting from the transition piece cooling flow, the negative impact of the crossflow is minimized by the use of collars or cooling conduits, also referred to as a thimbles, that are inserted into the cooling holes in the combustor liner flow sleeve, through which the cooling jets pass. These thimbles provide a physical blockage to the cross flow which forces the crossflow into the desired flow path while simultaneously ensuring that the cooling jets effectively impinge on the combustor liner surface to be cooled.

The thimbles or collars are preferably mounted in each hole of at least the first row of holes at the aft end of the flow sleeve, adjacent a mounting flange where the combustor liner and transition piece are joined. This arrangement decreases the gap between the jet orifice and impingement surface; blocks the cross flow that deflects the jets and forces it into the desired flowpath for the subsequent jet rows; allows the diameter of the jet to be smaller and thereby reduce cooling air; and provides consistent and accurate control over the location of jet impingement. It also stabilizes unwanted axial oscillation of the first row of jets, and prevents the formation of a thick boundary layer (and resulting reduced heat transfer) upstream of the first row of jets.

Accordingly, in its broader aspects, this invention relates to a combustor for a turbine that includes: a combustor liner; a first flow sleeve surrounding the liner, the flow sleeve having a plurality of rows of cooling holes formed about a circumference of the flow sleeve; a transition piece connected to the combustor liner and the flow sleeve and adapted to carry hot combustion gases to a stage of the turbine; the transition piece surrounded by a second flow sleeve; wherein a first of the plurality of rows of cooling in the first flow sleeve is located adjacent the transition piece; and further wherein one or more cooling conduits are mounted in the cooling holes of at least the first of the plurality of rows of cooling holes.

In another aspect, the invention relates to combustion liner flow sleeve adapted for mounting in surrounding relationship to a combustion liner, the flow sleeve comprising a tubular body formed with plural rows of cooling holes, one of the plural rows located adjacent one end of the flow sleeve; and a cooling conduit mounted in each hole of at least the first row of holes, the cooling conduits projecting radially into the flow sleeve.

In still another aspect, the invention relates to a method of cooling a combustor liner of a gas turbine combustor, the combustor liner having a substantially circular cross-section, and a flow sleeve surrounding the liner in substantially concentric relationship therewith creating an annulus therebetween; the method comprising a) providing a plurality of axially spaced rows of cooling holes in the flow sleeve, each row extending circumferentially of the flow sleeve, one of the rows adjacent a forward or downstream end of the flow sleeve; b) locating a plurality of cooling conduits in the cooling holes of at least the first of the rows, the cooling conduits extending radially towards, but not engaging, the liner; and c) supplying cooling air to the annulus such that the cooling conduits direct the cooling air against the liner.

DETAILED DESCRIPTION OF THE INVENTION

Figure 1:
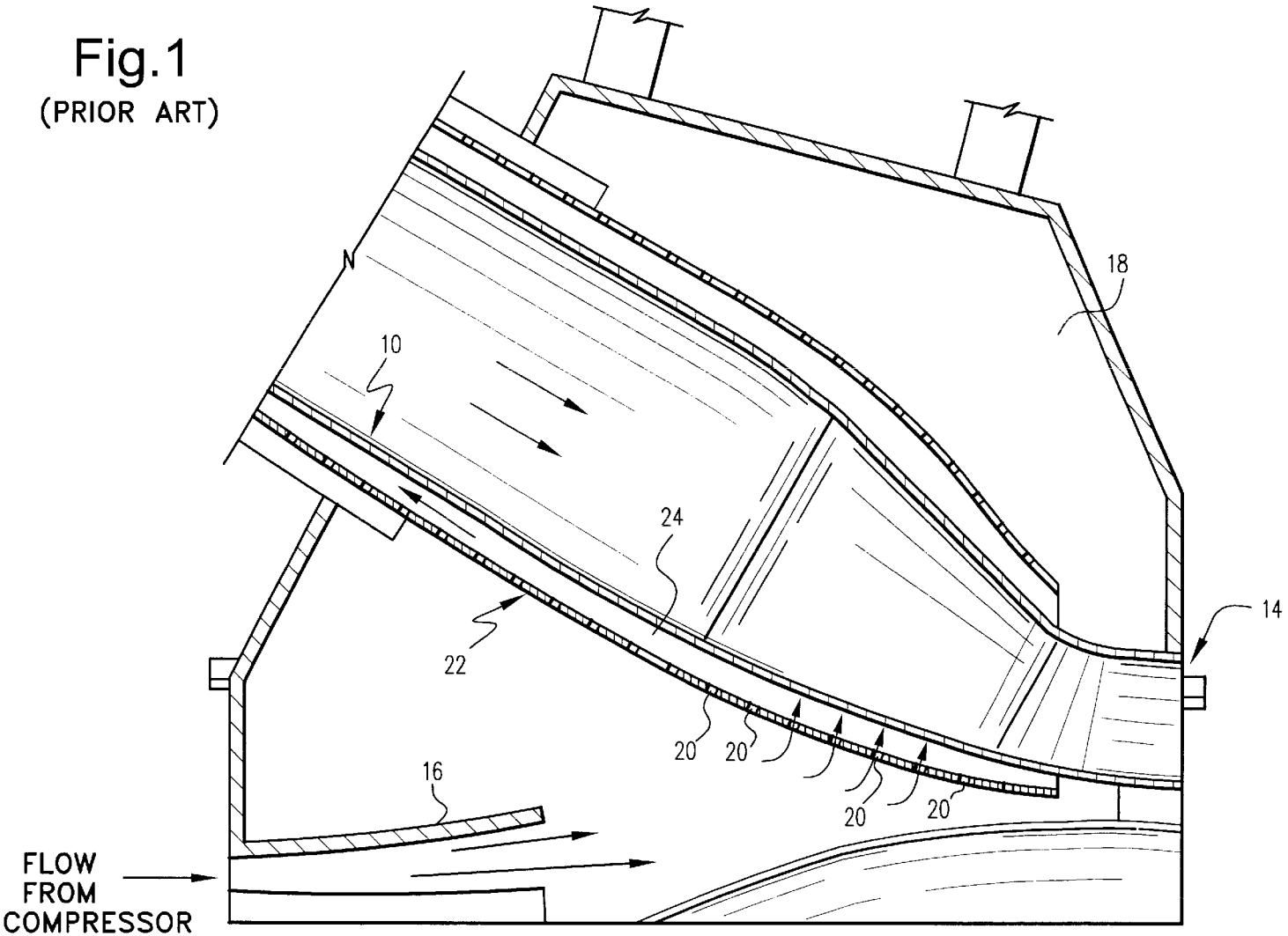
Fig.1 (PRIOR ART)
FIG. 1 is a simplified side cross section of a conventional combustor transition piece aft of the combustor liner.
Figure 2:
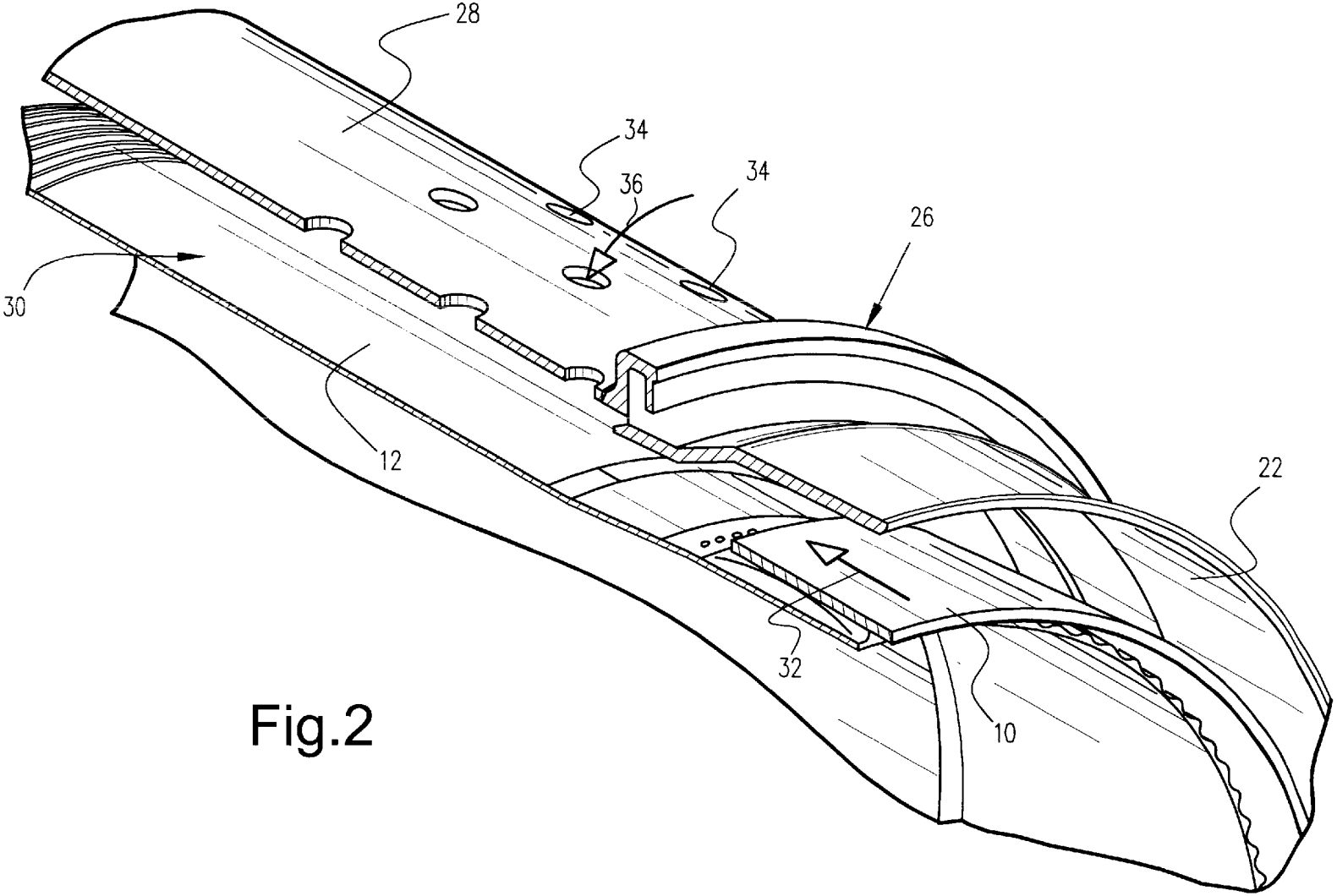
FIG. 2 is a partial but more detailed perspective of a conventional combustor liner and flow sleeve joined to the transition piece.

With reference to FIGS. 1 and 2, a typical gas turbine includes a transition piece 10 by which the hot combustion gases from an upstream combustor as represented by the combustor liner 12 are passed to the first stage of a turbine represented at 14. Flow from the gas turbine compressor exits an axial diffuser 16 and enters into a compressor discharge case 18. About 50% of the compressor discharge air passes through apertures 20 formed along and about a transition piece impingement sleeve 22 for flow in an annular region or annulus 24 (or, second flow annulus) between the transition piece 10 and the radially outer transition piece impingement sleeve 22. The remaining approximately 50% of the compressor discharge flow passes into flow sleeve holes 34 and mixes with the air from the transition piece from annulus 30 and eventually mixes with the gas turbine fuel in the combustor.

FIG. 2 illustrates the connection between the transition piece 10 and the combustor flow sleeve 28 as it would appear at the far left hand side of FIG. 1. Specifically, the impingement sleeve 22 (or, second flow sleeve) of the transition piece 10 is received in a telescoping relationship in a mounting flange 26 on the aft end of the combustor flow sleeve 28 (or, first flow sleeve), and the transition piece 10 also receives the combustor liner 12 in a telescoping relationship. The combustor flow sleeve 28 surrounds the combustor liner 12 creating a flow annulus 30 (or, first flow annulus) therebetween. It can be seen from the flow arrow 32 in FIG. 2, that crossflow cooling air traveling in the annulus 24 continues to flow into the annulus 30 in a direction perpendicular to impingement cooling air flowing through the cooling holes 34 (see flow arrow 35) formed about the circumference of the flow sleeve 28 (while three rows are shown in FIG. 2, the flow sleeve may have any number of rows of such holes).

Figure 3:
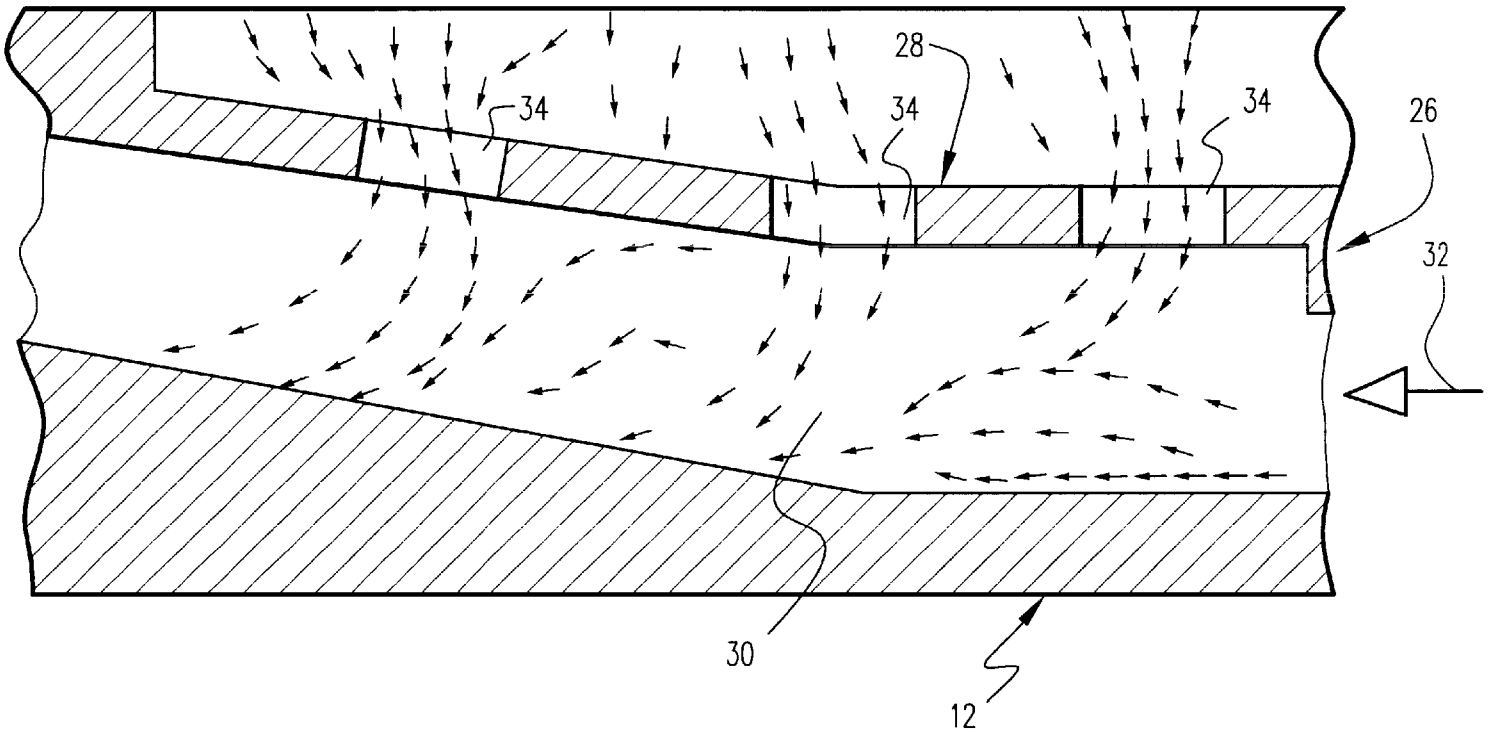
Fig.3 (PRIOR ART)
FIG. 3 is a flow diagram illustrating impingement cooling of the combustor liner in a prior arrangement.
Figure 5:
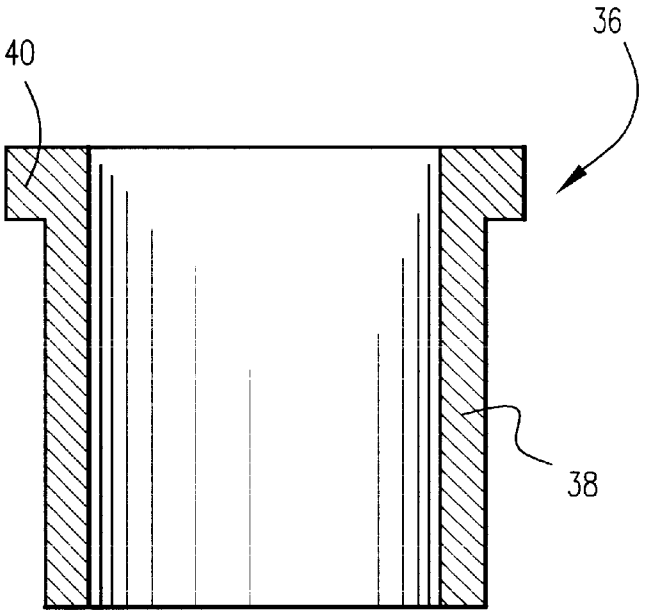
FIG. 5 is a side section of the thimble shown in FIG. 4.

The impingement cooling flow in the first row of holes 34 in the flow sleeve (the row of holes closest to the mounting flange 26) is particularly subject to disruption by the crossflow from the annulus 24. The negative impact can be seen in FIG. 3. The test impingement sleeve/combustor liner configuration shown in FIG. 3 is slightly different than the arrangement in FIG. 2, but similar reference numerals are used for ease of understanding. The cross flow impacts on the first row cooling jets exiting the holes 34, bending them over and degrading their ability to impinge upon the liner 12. Depending on the relative strengths of the cross flow and jets, the jet flow may not even reach the surface of the combustor liner 12. Because the impingement jets are high velocity, there is a characteristic zone of low static pressure behind the jets and near the flow sleeve entrance hole. The cross flow accelerates toward the low pressure zone, leading to a velocity gradient across the flow sleeve/liner annulus 30. The resulting low velocity and thickened boundary layer near the liner surface has very poor heat transfer effectiveness.

Figure 4:
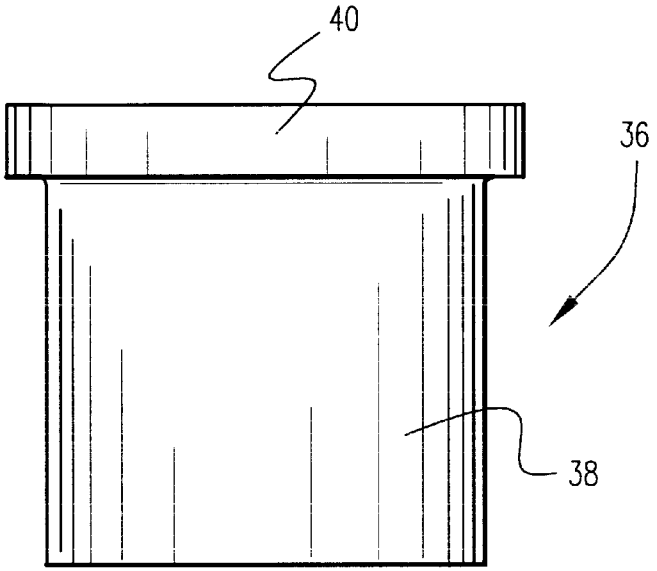
FIG. 4 is a side elevation of a cooling thimble in accordance with the invention.

To neutralize the negative impact of the crossflow on the cooling jets, cooling thimbles 36 as shown in FIG. 4 are employed. These thimbles may comprise tubes 38 of circular cross section, with a flat ring or flange 40 welded to its top. The dimensions of the thimbles 36 are set by the liner/flow sleeve gap, the tolerance of this dimension, the jet and cross flow momentum, the geometric constraints of the thimble, and the specific cooling requirements. A single thimble 36 is inserted into each of the first row flow sleeve holes 34 and welded at the ring or flange 40 to the outside of the flow sleeve 28. There are 20 thimbles mounted in a like number of holes 34 around the circumference of the flow sleeve 28 in at least the first row adjacent mounting flange 26, but they could be added to the second and/or third row as well. The critical location to be cooled in one exemplary embodiment, has been determined to be about 30 inches from the opposite end of the flow sleeve (not shown).

The cross section of the tube 38 is shown to be circular but other cross-sectional shapes could be used, e.g., square, triangular, airfoil-shaped, semi-circular and the like. An open channel-shape could also be used.

Figure 6:
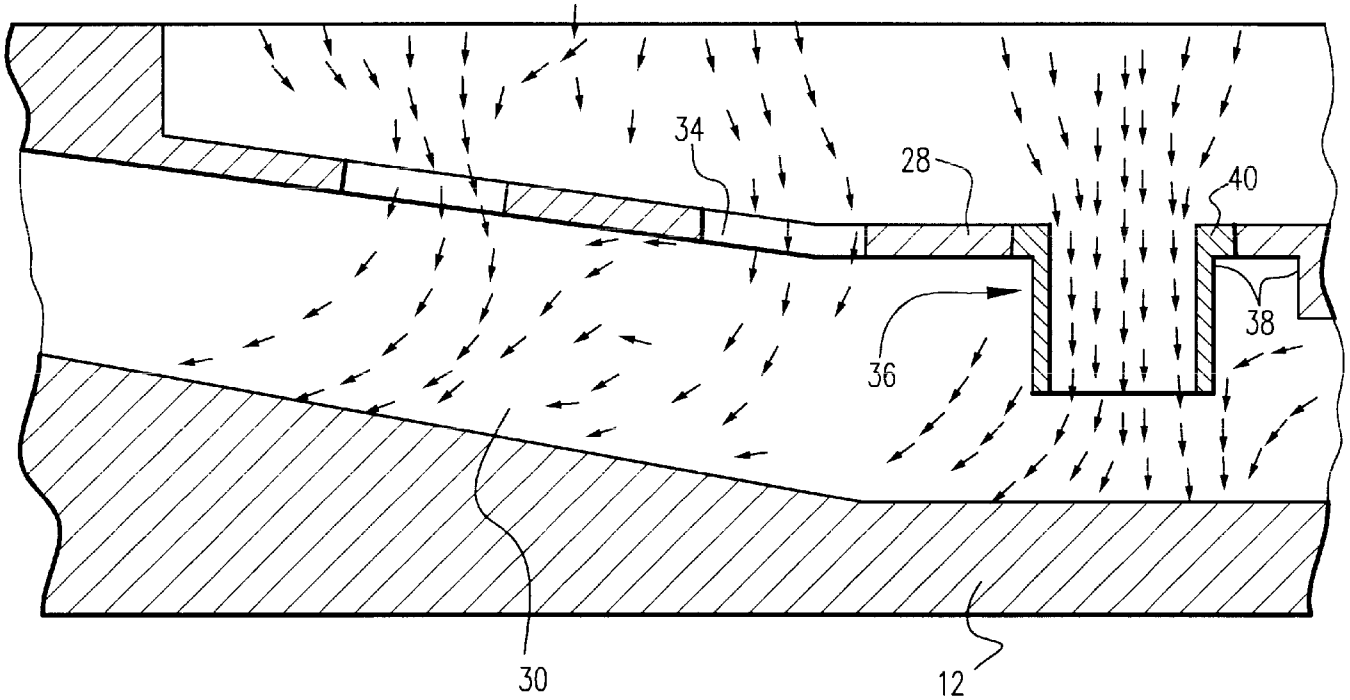
FIG. 6 is a flow diagram illustrating impingement cooling of the combustor liner in accordance with this invention.

FIG. 6 shows a cross section revealing the flow field in the liner/flow sleeve annulus with the thimbles 36 in place. This figure may be contrasted with FIG. 3 to identify the benefits of enhancing first row jets by use of flow sleeve thimbles. It is particularly evident that impingement cooling of the liner 12 is enhanced at the first row of holes 36, and that the crossflow has been blocked at least to the extent of allowing cooling jets from the impingement cooling holes 34 to reach the surface of the liner 12. In fact, it has been established that the thimbles add 150 BTU/HR*ft$^2$*F to the liner heat transfer coefficient at the first row jet centerline, 29.2 inches from the opposite end of the flow sleeve.

The device and process in accordance with this invention can be used in any impingement cooling application where there is a crossflow present at the first row of jets.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a combustor for a turbine:

a combustor liner;

a first flow sleeve surrounding said combustor liner with a first flow annulus therebetween, said first flow sleeve having a plurality of rows of cooling holes formed about a circumference of said first flow sleeve for directing cooling air into said first flow annulus;

a transition piece connected to said combustor liner and said first flow sleeve and adapted to carry hot combustion gases to a stage of the turbine; said transition piece surrounded by a second flow sleeve formed with an array of cooling apertures for directing cooling air into a second flow annulus between the second flow sleeve and the transition piece, said first flow annulus connecting to said second flow annulus; wherein a first of said plurality of rows of cooling holes in said first flow sleeve is located adjacent said transition piece; and further wherein one or more cooling conduits are mounted in the cooling holes of at least said first of said plurality of rows of cooling holes in said first flow sleeve for directing cooling air into said first flow annulus to impingement cool the combustor liner and mix with cooling air from said second flow annulus.

2. The combustor of claim 1 wherein said cooling conduits each include a tube with a radial flange at one end thereof.

3. The combustor of claim 2 wherein each said cooling conduit is welded to said flow sleeve, with an opposite end of said tube spaced from said liner by a predetermined space.

4. The combustor of claim 2 wherein one of said plurality of cooling conduits are circular in cross-section.

5. A method of cooling a combustor liner of a gas turbine combustor, said combustor liner having a substantially circular cross-section, and a first flow sleeve surrounding said liner in substantially concentric relationship therewith creating a first flow annulus therebetween for feeding air to the gas turbine combustor, and wherein a transition piece is connected to said combustor liner, with the transition piece surrounded by a second flow sleeve, thereby creating a second flow first annulus in communication with said first flow first annulus; the method comprising:

a) providing a plurality of axially spaced rows of cooling holes in said flow sleeve, each row extending circumferentially of said flow sleeve, a first of said rows adjacent said transition piece and said second flow sleeve;

b) locating a plurality of cooling conduits in the cooling holes of at least said first of said rows, said cooling conduits extending radially inwardly towards, but not engaging, said combustor liner;

c) supplying cooling air to said cooling holes such that said cooling conduits direct said cooling air against said combustor liner; and d) thereafter, directing said cooling air axially within said first flow annulus.

6. The method of claim 5 wherein said cooling conduits each include a tube with a radial flange at one end thereof.

7. The method of claim 6 wherein said tube has a circular cross section.

8. A gas turbine combustor assembly comprising a combustor liner and a transition piece connected to a downstream end of the combustor liner, the transition piece adapted to carry hot combustion gases in a first flow direction to a first stage of a gas turbine; a first flow sleeve surrounding the combustor liner with a first flow annulus radially therebetween; a second flow sleeve surrounding the transition piece with a second flow annulus radially therebetween, with said first annulus communicating directly with said second flow annulus; a plurality of rows of impingement cooling holes in said first flow sleeve, at least one of said plurality of rows located adjacent said transition piece at said downstream end of the combustor liner with a plurality of cooling conduits located in the impingement cooling holes of at least a first of said plurality of rows in said first flow sleeve and projecting toward said combustor liner; wherein, in use, cooling air flows through said cooling conduits to impinge on said combustor liner and mix with cooling air flowing through said first and second flow annuli in a second flow direction counter to said first flow direction.

* * * * *

UNITED STATES PATENT AND TRADEMARK OFFICE

CERTIFICATE OF CORRECTION

PATENT NO. : 6,484,505 B1
DATED : November 26, 2002
INVENTOR(S) : Brown et al.

It is certified that error appears in the above-identified patent and that said Letters Patent is hereby corrected as shown below:

Column 2,
Line 22, after "cooling" insert -- holes --.

Column 3,
Line 41, after "row" insert -- of --.

Column 5,
Line 3, delete "first" (first occurrence).
Line 4, delete "first."

Signed and Sealed this

First Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,484,505 B1
APPLICATION NO. : 09/513070
DATED : November 26, 2002
INVENTOR(S) : Brown et al.

It is certified that error appears in the above-identified patent and that said Letters Patent is hereby corrected as shown below:

In Column 1, below the title, insert:

--The Government of the United States of America has rights in this invention pursuant to Contract No. DE-FC21-95MC31176 awarded by the U. S. Department of Energy.--

Signed and Sealed this

Twentieth Day of February, 2007

JON W. DUDAS
*Director of the United States Patent and Trademark Office*